US006530760B1

(12) United States Patent
Graber et al.

(10) Patent No.: US 6,530,760 B1
(45) Date of Patent: Mar. 11, 2003

(54) AIR COMPRESSOR

(75) Inventors: Tom Graber, Longmont, CO (US); Paul Klimek, New Ulm, MN (US); Jan Davidson, Springfield, MN (US)

(73) Assignee: Coleman Powermate, Inc., Kearney, NE (US)

( * ) Notice: Subject to any disclaimer, the term of this patent is extended or adjusted under 35 U.S.C. 154(b) by 0 days.

(21) Appl. No.: 09/637,560

(22) Filed: Aug. 11, 2000

(51) Int. Cl.[7] ..... F04B 39/10
(52) U.S. Cl. ..... 417/545
(58) Field of Search ..... 417/545, 487, 417/368, 44.1; 92/186, 172, 240, 208, 209, 234, 235, 255

(56) References Cited

U.S. PATENT DOCUMENTS

| | | | | | |
|---|---|---|---|---|---|
| 3,695,150 | A | * | 10/1972 | Salzmann | 123/18 R |
| 3,992,980 | A | * | 11/1976 | Ryan et al. | 123/41.38 |
| 4,068,563 | A | * | 1/1978 | Ryan et al. | 123/41.38 |
| 4,078,529 | A | * | 3/1978 | Warwick | 123/44 |
| 4,292,937 | A | * | 10/1981 | Vallaude | 123/193.6 |
| 4,498,848 | A | | 2/1985 | Petrovsky et al. | 417/253 |
| 4,694,735 | A | * | 9/1987 | Tatematsu et al. | 123/193.6 |
| 4,730,550 | A | | 3/1988 | Bramstedt et al. | 92/240 |
| 4,848,213 | A | | 7/1989 | Wood et al. | 92/172 |
| 4,961,016 | A | | 10/1990 | Peng et al. | 310/62 |
| 5,022,822 | A | | 6/1991 | Sincere | 416/219 |
| 5,231,917 | A | * | 8/1993 | Wood | 92/186 |
| 5,282,412 | A | | 2/1994 | Ebbing | 92/240 |
| 5,343,777 | A | | 9/1994 | Wood et al. | 74/598 |
| 5,482,436 | A | | 1/1996 | Bohanon | 416/203 |
| 5,584,675 | A | | 12/1996 | Steurer et al. | 417/372 |
| 5,644,969 | A | * | 7/1997 | Leu et al. | 92/169.1 |
| 5,649,807 | A | | 7/1997 | Lee et al. | 416/223 |
| 5,655,887 | A | | 8/1997 | Chou | 417/63 |
| 5,865,153 | A | * | 2/1999 | Matsumoto | 123/299 |
| 5,937,736 | A | * | 8/1999 | Charpie | 92/240 |
| 5,980,219 | A | | 11/1999 | Spurny | 417/296 |
| 6,011,903 | A | | 1/2000 | Nosenchuck | 392/385 |
| 6,016,833 | A | | 1/2000 | Spurny et al. | 137/512.1 |

* cited by examiner

*Primary Examiner*—Teresa Walberg
*Assistant Examiner*—Daniel Robinson
(74) *Attorney, Agent, or Firm*—Leydig, Voit & Mayer, Ltd.

(57) ABSTRACT

An air compressor includes a valve plate with cooling fins and a piston also having cooling fins. The valve plate includes an integral and angled valve plate outlet. The angling of the valve plate outlet reduces turbulence and improves compressed air flow. The pump frame of the gas compressor includes a lipless bearing bore, decreasing the distance between the portion of the frame supporting the bearing and the piston. The pump frame is flat such that a portion of the cylinder is over a portion of the motor. The flatness of this arrangement increases the strength of the pump frame. The piston bearing bore includes two clamping structures having screw holes. Each screw hole is formed from a series half-cylinder or barrel portions, which individually do not form the complete circumference of a hole. Such a screw hole does not require a core pull on casting, lowering manufacturing costs. The piston includes a piston seal which is angled with respect to the piston. The piston head is machined at an angle to lower the amount of dead space near the top of the cylinder. The compressor includes a fan which operates efficiently at different speed settings. The fan is a radial fan including two sets of fan blades, a set of inner flat fan blades which operate most efficiently at a first range of speeds and a set of outer curved fan blades which operate most efficiently at a second range of speeds. The fan blows air through the compressor in a novel air cooling pattern, propelling air axially upward along the outside of the cylinder, increasing cooling efficiency.

7 Claims, 5 Drawing Sheets

AIR COMPRESSOR

FIELD OF THE INVENTION

The present invention relates to air compressors, in particular, oilless air compressors.

BACKGROUND INFORMATION

Generally, an oilless air compressor (also termed an air pump) provides a supply of compressed air. One configuration of an oilless air compressor includes an electric motor rotating an eccentric which, in turn, causes a piston to reciprocate up and down within a cylinder. The eccentric translates the rotary motion of the motor into a reciprocating motion for the piston. On a piston down-stroke air is pulled into the cylinder and on a piston up-stroke air is pushed out of the cylinder.

In such a design, a valve plate closes the end of the cylinder above the piston. The valve plate includes one or more inlet valves that allow air at atmospheric pressure to be pulled into the cylinder on the piston's down-stroke, but do not allow compressed air to escape to the atmosphere on the piston's up-stroke. The valve plate also includes one or more exhaust valves that allow compressed air to be pushed out of the cylinder on the piston's up-stroke but do not allow the compressed air to be pulled into the cylinder on the piston's down-stroke.

A valve plate in such an arrangement may include an outlet port leading to, for example', a pressurized air tank. On a piston up-stroke, air flows out of the outlet valves, into a chamber above the valve plate, and out of the outlet port. The arrangement of the outlet valves and the outlet port may be such that the output air flow effectively makes a 180 degree turn in the chamber, rising straight up out of the cylinder, being redirected, and exiting the outlet port in the opposite direction. This change in airflow creates turbulence and back pressure, lowering the efficiency of the compressor.

The outlet port in such a valve plate may be formed from both a threaded portion and a compression fitting made, for example, of brass. The compression fitting includes two threaded portions: one connecting with the threaded portion of the valve plate and another connecting with an outlet tube, which may be made of metal such as copper or aluminum. The tube attaches to the fitting via a compression nut and sleeve. The fitting is a discrete component which results in an increased parts count, a potential leak point, a more complex manufacturing process and greater costs.

One eccentric as used in such a compressor design includes a bearing boss, which lies outside of the axis of the motor. As the motor turns the eccentric boss moves in a circle. The boss is rotatably attached to the bottom of the piston by rotatably connecting to a piston bearing bore, a circular hole at the bottom of the piston. As the motor turns the eccentric, the piston is moved up and down. The eccentric boss is surrounded by a bearing; the bore at the bottom of the piston clamps around the bearing. The bearing reduces friction between the eccentric boss and the piston. The piston bearing bore may not be a complete circle in that a slit or small gap exists at the bottom of the piston. This slit or gap allows the bore to expand and contract slightly and allows the tension of the piston bearing bore against the bearing to be adjusted. Two clamping structures extend from the bottom of the piston, one on either side of the slit or gap, and include screw holes. A screw and bolt may be inserted into the clamping structures to alter the tension of the bore against the bearing.

The piston may be die-cast as one component. As the die-cast tool closes, molten metal is injected into the tool, and then the tool separates. The screw hole through the clamping structures extends in the direction that the tool parts separate; to create the hole a core pull is added to the die-cast tool. The use of the core pull adds to the cost of creating the piston.

Such a compressor configuration typically includes a pump frame which is attached to the motor assembly and also to the cylinder. The pump frame supports the cylinder and, since the axle of the motor extends through a bore in the pump frame to attach to the eccentric, the pump frame also helps to support the piston. A bore in the frame holds a bearing which supports the motor axle. The frame bore may include a lip on its outside edge which provides a stop for the bearing when it is pressed into the bore during manufacturing. Such a lip increases the distance between the portion of the frame supporting the axle (through the bearing) and the piston, thereby increasing the moment of force and thus increasing the stress in the frame bearing and the frame.

The spacing of the cylinder outwardly from the motor also adds to the moment and the stress on the bearing. Further, a compressor may include a pump frame with a face which is bowed outward, away from the motor. This also increases the distance between the portion of the pump frame supporting the axle and the piston.

In certain compressor designs, as the piston is forced up and down by the eccentric, the piston also wobbles, or rocks within the cylinder. Such designs may include a flexible seal, formed of a material not requiring oil lubrication, which extends around the perimeter of the piston to ensure the space above the piston is sealed as the piston rocks.

One factor reducing the life of such a piston seal is the angle of the piston during the compression stroke. When the piston is at its top dead center, the head of the piston is flat with respect to the cylinder and the surface of the cylinder head is perpendicular to the axis of the cylinder. Due to piston wobble, however, the piston head is slanted against the cylinder during both the up-stroke and the down-stroke. During the up-stroke, in which air is compressed, the piston seal is pressed unevenly against the cylinder, causing excessive wear of the piston seal.

As air is compressed by the piston, it is heated. The heated air heats components of the air compressor, causing faster wear and reducing operating efficiency. An important factor contributing to piston seal wear is its operating temperature; as the operating temperature increases the life of the seal decreases. To reduce the temperature of such pumps a cooling fan may be included. Due to the location of the fan and the arrangement of the components of certain compressors, such a cooling fan may blow air in a direction more or less perpendicular to the axis of the cylinder. Such an air flow arrangement, however, cools the cylinder inefficiently. The fan is typically connected directly to the eccentric boss and thus rotates at the same speed as the motor. While the compressor and motor may operate at different speeds, the fan may be most efficient at only one speed.

One technique for reducing heat in air compressors is described in U.S. Pat. No. 5,937,736 to Charpie. Charpie describes a piston cap having cooling fins. The piston cap is secured to the piston head, and the cooling fins extend through holes on the piston head. Such a solution is imperfect, as heat is effectively removed only from the piston head. While the cap is secured to the head, heat does not transfer effectively across gaps in metal, and thus the piston head and the piston rod (which is integral with the piston head) are not cooled by the heat sink action of the fins. The size, shape and number of the holes in the piston head limit the size, shape and number of the cooling fins. Further, a piston head with holes for cooling fins may be harder or more costly to manufacture. It is desirable to have a more efficient means for cooling a piston that also allows for easier and less costly construction.

As discussed, when the piston is at its top dead center, the head of the piston is flat with respect to the cylinder, and the surface of the cylinder head is perpendicular to the axis of the cylinder. As the piston tilts away from top dead center, one edge of the piston head rises higher than the center of the piston head. Thus a clearance volume must be provided between the top of the piston and the valve plate. This clearance volume results in a dead space above the piston, reducing the efficiency of the compressor and increasing the heat levels in the compressor.

It is desirable to have an air compressor which overcomes at least some or all of the aforementioned shortcomings of known air compressors.

SUMMARY OF THE INVENTION

The present invention provides an air compressor which overcomes the above-described problems of known air compressor designs. An air compressor in accordance with the present invention is more efficient in operation; comprises a piston which experiences less wear, has a more efficient means of cooling and is less expensive to manufacture; allows for reduced stress on the frame and bearings in operation; comprises a more efficient and effective cooling system; and is easier and less costly to construct.

An air compressor according to a preferred embodiment of the present invention includes a valve plate with cooling fins and a piston also having cooling fins. The valve plate includes an integral and angled valve plate outlet suitable for direct connection to a tube. Making the valve plate outlet integral with the valve plate allows for a simpler valve plate with a reduced number of parts, and thus a lesser cost. Angling the valve plate outlet relative to the valve plate reduces turbulence in the space above the cylinder as air is expelled from the compressor, as the exiting air is redirected at an angle of less than 180 degrees. This helps to lower flow resistance which decreases back pressure and increases efficiency.

In an exemplary embodiment, the bearing bore of the pump frame is lipless, decreasing the distance between the portion of the frame supporting the axle and the piston, decreasing the moment of force along the axle and the piston, and thus decreasing the stress on the frame and the frame bearing. Because the pump frame is flat and a portion of the cylinder is over a portion of the motor, the distance between the piston and the portion of the frame supporting the axle is decreased.

In a preferred embodiment, the piston of the compressor includes a novel design allowing for a less expensive casting process. The tension of the piston bearing bore may be adjusted by applying tension to two clamping structures. Tension is provided by a screw passing through clamping screw holes on each of the clamping structures. Each screw hole is formed from a series of structures, such as arcs, arches or barrel portions, which individually do not form the complete circumference of a hole, but when taken together form one or more holes. Such a screw hole does not require a core pull on casting, lowering manufacturing costs.

To improve the longevity of the piston seal, an exemplary embodiment of a piston in accordance with the present invention includes a piston seal which is angled with respect to the major axis of the piston. By thus angling the piston seal, the angle of the piston seal with respect to the axis of the cylinder is closer to perpendicular during a longer portion of the up-stroke than is achievable if the piston seal were not angled with respect to the major axis of the piston.

In a further exemplary embodiment, the piston head has a beveled face formed by two substantially planar portions which meet along a ridge which is substantially perpendicular to the plane in which the piston rocks. As the piston approaches and leaves top dead center, the beveled face of the piston allows the piston to approach the valve plate more closely, thereby reducing efficiency-robbing dead space between the piston and the valve plate.

In a preferred embodiment, the piston also includes cooling fins arranged on the back of the piston head and on the connecting rod. In addition to cooling the piston head directly, the cooling fins also cool the connecting rod which provides a large cooling area, substantially larger than the area of the piston head. The connecting rod is cooled by the ambient air through convection. The connecting rod, in turn, cools the piston head by conduction. This arrangement provides superior cooling of the piston over known arrangements.

In a preferred embodiment, the compressor includes a fan which operates efficiently at different speed settings. The fan is a radial fan including two sets of fan blades, a set of inner flat fan blades which operate most efficiently at a first range of fan speeds and a set of outer curved fan blades which operate most efficiently at a second range of speeds. The fan blows air through the compressor in a novel air cooling pattern, propelling air axially upward along the outside of the cylinder, increasing cooling efficiency.

DETAILED DESCRIPTION OF THE INVENTION

In the following description, various aspects of the present invention will be described. For purposes of explanation, specific configurations and details are set forth in order to provide a thorough understanding of the present invention. However, the present invention may be practiced using alternate configurations and arrangements. Furthermore, some well known features may be omitted or simplified in order not to obscure the present invention.

Figure 1:
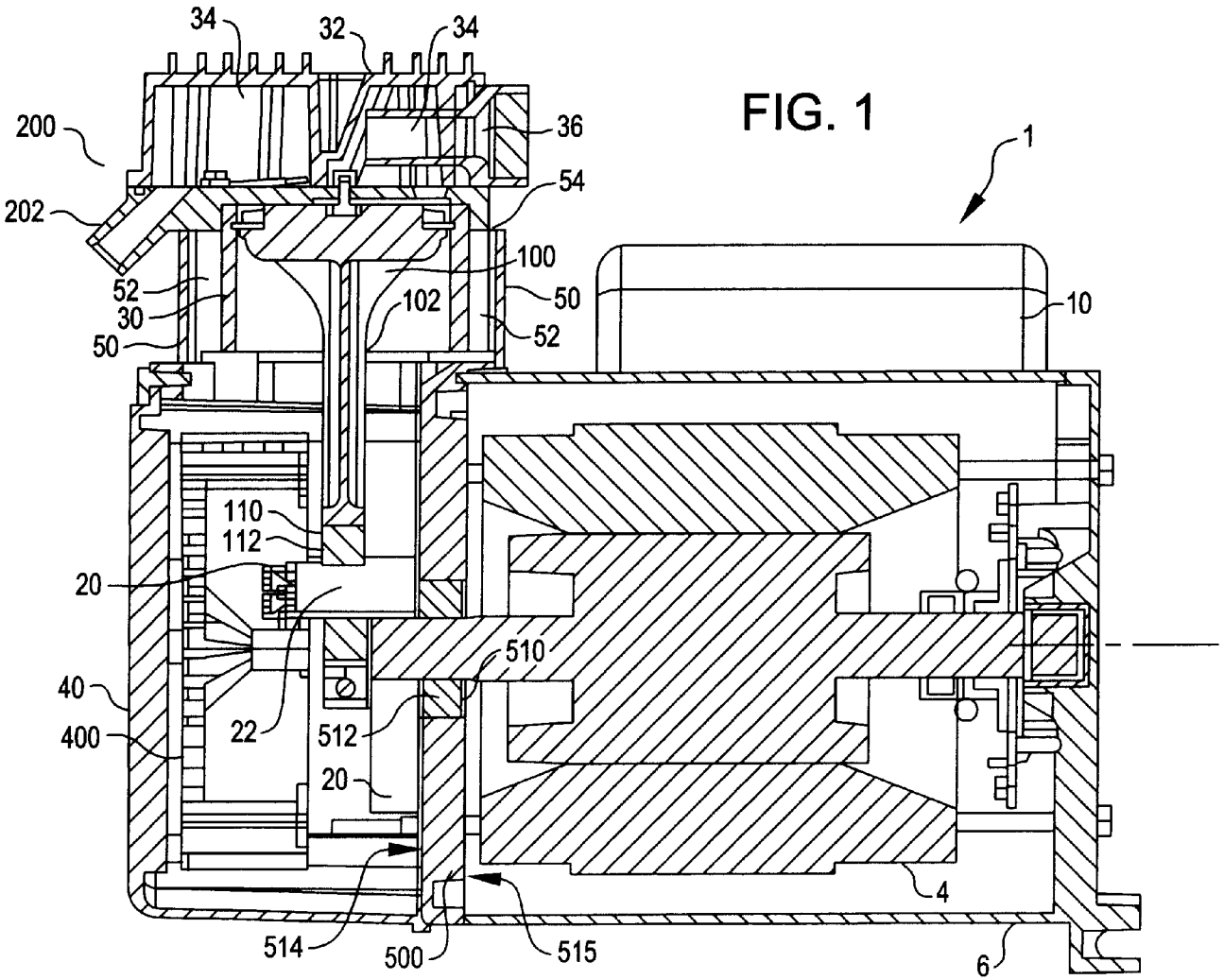
FIG. 1 illustrates a cross section of an embodiment of an air compressor in accordance with the present invention.

FIG. 1 illustrates a cross section of an embodiment of an air compressor in accordance with the present invention. Air compressor 1 includes a motor 4, contained within a housing 6, and having a rotor shaft 8. Capacitors 10 may be coupled to the motor 4 to increase torque on startup and during operation. The rotor shaft 8 connects to an eccentric 20, which in turn pivotally connects to a piston 100 at an eccentric boss 22. A piston connecting rod 102 connects the two ends of the piston 100. A fan 400 is also connected to the eccentric boss 22. The piston 100 moves up and down inside a cylinder 30, which is capped by a valve plate 200. A front face or shroud 40 covers the fan 400, piston 100 and eccentric 20, and includes vents allowing a cooling air flow to enter the compressor 1. A cylinder shroud 50 surrounds the cylinder 30, defines an air space 52 surrounding the cylinder 30, and includes vents 54 leading from the air space 52 to the ambient air. In FIG. 1, only one vent 54 is depicted, but multiple vents 54 may be included.

A cylinder head 32 sits above the valve plate 200 and in conjunction with the valve plate defines one or more chambers 34, 35. The cylinder head 32 includes an air compressor intake muffler 36, and the valve plate 200 includes a valve plate outlet 202, which is an angled, integral outlet port.

In operation, during a piston down-stroke, air enters the air compressor 1 via the intake muffler 36 and flows to an intake chamber 35, through the valve plate 200 and into the cylinder 30. During a piston up-stroke, the piston 100 pushes air out of the cylinder 30, through the valve plate 200 into an exhaust chamber 34 and out of the valve plate outlet 202.

The air compressor 1 includes a pump frame 500 attached to one end of the housing 6 and supporting one portion of the rotor shaft 8. The pump frame 500 includes a pump frame bearing bore 510 through which the rotor shaft 8 extends. The pump frame 500 has a face 514 on the side of the pump frame 500 opposite the motor 4 and a face 515 facing the motor 4. A pump frame bearing 512 sits inside the pump frame bearing bore 510 and supports the rotor shaft 8 through the pump frame 500. The piston 100 includes a piston bearing bore 110 through which the eccentric boss 22 extends. A piston bearing 112 is seated in the piston bearing bore 110, and reduces friction between the eccentric boss 22 and the piston bearing bore 110.

Figure 2:
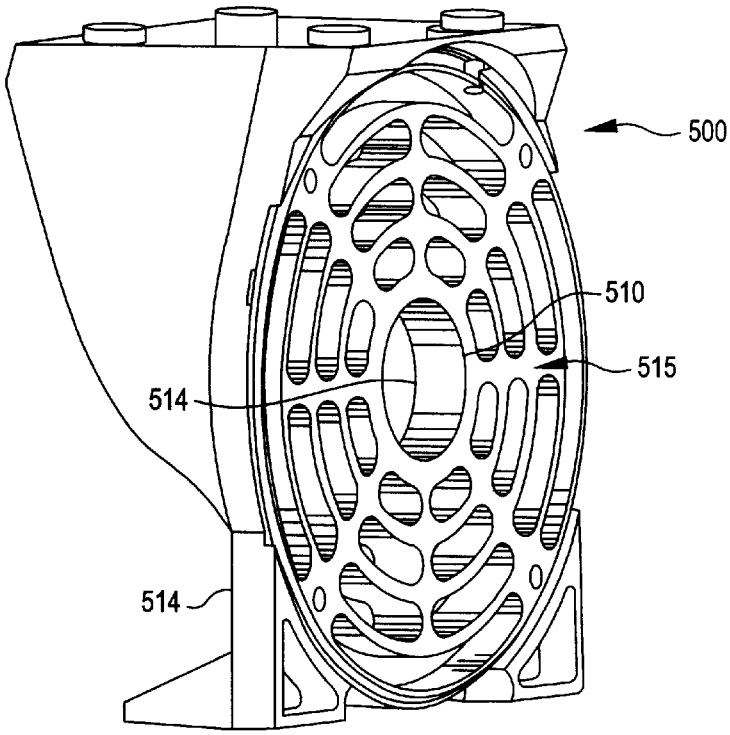
FIG. 2 is a perspective view of the pump frame of the embodiment of the air compressor of FIG. 1.

FIG. 2 is a perspective view of the pump frame 500 of the embodiment of the air compressor of FIG. 1. As can be seen in FIG. 2, the pump frame bearing bore 510 lacks a lip, and the pump frame bearing 512 is held inside the bearing bore 510 with a friction fit. In one embodiment the bearing bore 510 is a substantially smooth, unobstructed cylinder. Preferably, the pump frame bearing 512 is installed to be flush with the face 514 of the pump frame 500 which faces the cylinder 30.

Because the bearing bore 510 lacks a lip, the pump frame bearing 512 is allowed to extend in the pump frame bore 510 up to the pump frame face 514, thereby allowing the pump frame bearing 512 to be closer to the axis of the piston 100, thus decreasing the moment of force on the eccentric 20 and piston 100 and thus decreasing the stress on the pump frame bearing 512 and the pump frame 500. This arrangement increases the life of the bearing 512. Eliminating the pump frame lip also reduces the stress on the bearing on the back end of the motor 4. Further, smaller and thus less expensive bearings may be used. Moreover, because the pump frame bearing bore 510 lacks a lip, a machining step may be eliminated, reducing the cost of the air compressor 1.

In an exemplary embodiment of the present invention, the face 514 of the pump frame 500 is substantially flattened, as opposed to being bowed or curved out. Because the pump frame 500 is substantially flattened, the cylinder 30 is allowed to be closer to the motor than in current designs, further decreasing the moment of force on the frame 500 and the bearing 512. In a preferred embodiment of the present invention, at least a portion of the cylinder 30 is located at least partially over a portion of the motor 4.

During manufacturing, an automatic tooling machine can be used to insert the pump frame bearing 512 into the pump frame bearing bore 510. The pump frame bearing 512 is friction fitted into the pump frame bearing bore 510. Automatically inserting the pump frame bearing 512 into a lipless bore is more difficult if the pump frame 500 is bowed out, as with conventional designs, as a stop (such as a flat surface or tool) is needed to ensure that the pump frame bearing 512 is not pushed all the way through the bore. Thus the flat pump frame 500 according to an embodiment of the present invention also allows for the easier manufacture of a lipless pump frame bore.

Figure 3:
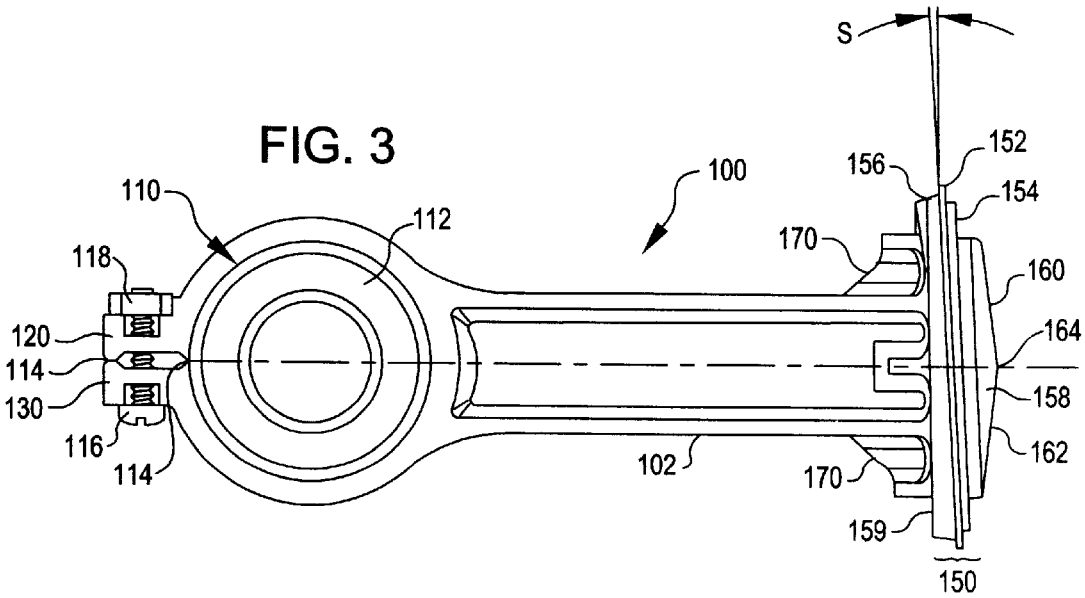
FIG. 3 is a side view of an exemplary embodiment of an air compressor piston in accordance with the present invention.

FIG. 3 is a side view of the piston of the embodiment of the air compressor of FIG. 1. Generally, the piston 100 includes a piston bearing bore 110 at one end and a piston head 150 at the opposite end. A piston connecting rod 102 joins the two ends of the piston 100. The piston head 150 includes a piston face 158, for compressing air, and a back side 159, which faces the connecting rod 102. The piston 100 preferably includes a set of piston cooling fins 170, preferably extending from the back side 159 of the piston head 150 and possibly from the connecting rod 102. The piston 100 and its various features can be formed as a unitary component, such as by casting.

A piston bearing 112 is seated in the piston bearing bore 110. The eccentric boss 22 (FIG. 1) extends through the piston bearing 112. The end of the bearing bore 110 furthest from the piston head 150 includes a slit 114, allowing the bearing bore 110 to expand slightly. Two clamping structures 120 and 130 extend from the piston 100 on either side of the slit 114. Each clamping structure 120 and 130 includes a screw hole, depicted further in FIGS. 5–8. A screw 116 fits through the two screw holes and may be used to clamp the clamping structures 120 and 130 and thus adjust the tension of the piston bearing bore 110. The screw 116 may be loosened to allow the piston bearing 112 to be removed and replaced. The screw 116 is secured by a nut 118.

The piston head 150 includes a slanted or angled piston seal rim 156, which holds a flexible piston seal 152. A piston seal retainer 154 holds the piston seal 152 on the piston seal rim 156. The piston seal 152 extends beyond the width of the piston head 150 and acts to stop air from leaking around the piston 100 inside the cylinder 30. A line connecting any two points along the edge of the piston face 158, at the end of the piston head 150, is generally perpendicular to the axis of the piston 100. When viewed from certain directions, the piston seal rim 156 deviates a certain angle from such a line, and thus the piston seal rim 156 is not at a right angle to the axis of the piston 100. In a preferred embodiment, when viewed in the plane of the piston bearing bore 110, the piston seal rim 156 is not at a right angle to the axis of the piston 100. When viewed in an axis perpendicular to the plane in which the piston bearing bore 110 lies, the piston seal rim 156 is at substantially a right angle to the axis of the piston. Thus, if the piston face 158 is considered to be flat (in a preferred embodiment the piston face 158 includes angled planes), the piston seal rim 156 lies at an angle to the piston face 158. In a preferred embodiment, the axis of the piston 100 and the plane of the piston seal rim 156 form a 88.5 degree angle when measured in the plane of the piston bearing bore 110. The optimal angle will depend on the length of the piston and the size of the stroke.

The piston seal 152 lies substantially in the same plane as the angled piston seal rim 156. Therefore, when the piston 100 is at a certain point in its up stroke and is at a certain angle with respect to the axis of the cylinder 30, the piston seal 152 is closer to being perpendicular with the cylinder axis than with current designs. In an exemplary embodiment, the piston seal 152 is angled two degrees (i.e., angle S in FIG. 3) relative to a plane perpendicular to the major axis of the piston 100. As such, at top and bottom dead center, the piston seal 152 will be tilted two degrees relative to a plane perpendicular to the axis of the piston. Furthermore, given a typical connecting rod length and stroke, the maximum tilt of the seal 152 through the down-stroke will be nine degrees, but only five degrees through the up-stroke. For a similarly dimensioned, conventional piston with a flat piston seal, the maximum tilt will be seven degrees through both the up- and down-strokes. As mentioned, the lower degree of tilt in the more critical up-stroke afforded by the piston 100 of the present invention applies less wear on the piston seal 152.

In one embodiment, the compressor 1 may be generally manufactured from aluminum, except for parts such as electrical parts, seals and other parts requiring different materials. The cylinder 30 may be anodized and Teflon™ impregnated. The valves may be constructed of stainless steel. The seals such as the piston seal 152 may be constructed of Teflon™ and other materials. The rotor shaft 8 may be steel. Other suitable materials may also be used.

In a further aspect of the present invention, the face of the piston head 150 is beveled to accommodate the pivoting motion of the piston 100. In a compressor with a conventional, flat piston head, a space is required between the piston at top dead center and the valve plate so as to prevent the piston from striking the valve plate as the piston approaches and leaves top dead center. The piston 100 according to an embodiment of the present invention is designed so as to reduce the amount of this dead space by beveling the piston face 158, allowing the piston 100 to come closer to the valve plate 200 at top dead center.

As shown in FIG. 3, when viewed in a direction perpendicular to the plane of the pivoting motion (i.e., the plane of the piston bearing bore 110), the face 158 of the piston head 150 comprises two substantially planar surfaces 160 and 162 which slope upwards from the edge of the piston face 158 and meet along an edge 164, substantially in the center of the piston face 158. The edge 164 extends parallel to the axis of the piston bearing bore 110. In a preferred embodiment, the surfaces 160 and 162 meet at an angle of approximately 177 degrees. The optimal angle will depend on the bore stroke and connecting rod length. When viewed from a transverse direction, the piston head 158 appears substantially flat. This aspect of the piston head 158 can also be seen clearly in FIG. 6.

In a preferred embodiment, a fastener mounting arrangement on each of the clamping structures 120 and 130, for holding a clamping screw, is formed from a series of structures, such as arcs, arches or cylinder portions, which individually do not form the complete circumference of a hole, but when taken together form one or more holes. Preferably the arcs or cylinder portions share the same axis, through which a screw or other connecting member may be inserted.

In alternate embodiments the screw hole may support other types of fasteners and may be used on other structures requiring fasteners. For example, a fastener mounting arrangement in accordance with the present invention may use arched or half-cylinder surfaces to hold a fastener or screw in any application requiring a fastener where easy, inexpensive manufacturing is desired.

Figure 4:
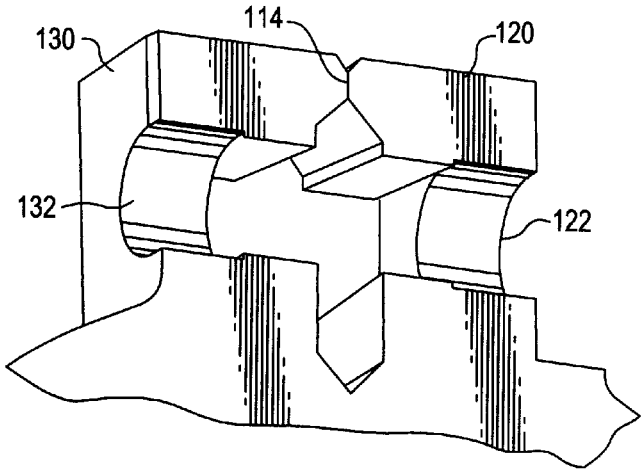
FIG. 4 is a partial cutaway view of the clamping features of an exemplary embodiment of an air compressor piston in accordance with the present invention.
Figure 5:
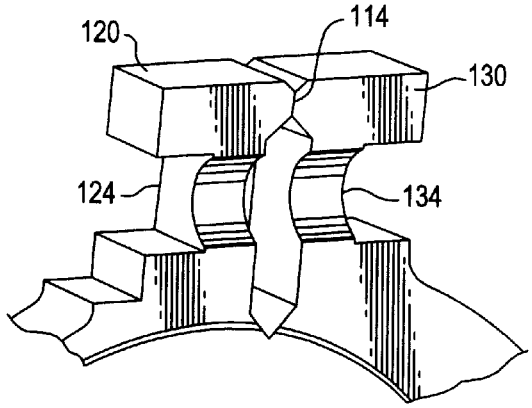
FIG. 5 is a further partial cutaway view of the clamping features of an exemplary embodiment of an air compressor piston in accordance with the present invention.

FIG. 4 is a partial cutaway view of the clamping structures of the piston of the embodiment of the air compressor of FIG. 1. FIG. 5 is an opposing partial cutaway view of the clamping structures of the piston of the embodiment of the air compressor of FIG. 1. FIGS. 4 and 5 each show portions of the clamping structures 120 and 130; the clamping structures 120 and 130, and the piston 100 are shown whole in FIGS. 3, 6 and 7. The portion of the clamping structures 120 and 130 shown in FIG. 4 corresponds to the portion of the clamping structures 120 and 130 shown in FIG. 5.

Referring to FIGS. 4 and 5, a bore is formed through each of the clamping structures 120 and 130 from a pair of arcuate members 122, 124 and 132, 134, respectively, each of which is generally a half-cylinder. Two half-cylinders are arranged on each clamping structure 120 and 130: the clamping structure 120 includes half-cylinders 122 and 124, and the clamping structure 130 includes half-cylinders 132 and 134. The two bores thus formed are aligned with a common axis so as to allow a fastener, such as a bolt or screw, to extend therethrough. The clamping structure 120 is separated from the clamping structure 130 by the slit 114. The half-cylinder 122 does not overlap the half-cylinder 124, and the half-cylinder 132 does not overlap the half-cylinder 134. The bores formed by the half-cylinders 122, 124, 132 and 134 to not form a complete cylinder yet may still entrain a fastener placed therethrough. In each clamping structure 120 and 130, half of the respective bore is formed by each disjoint half-cylinder. This disjoint half-cylinder structure according to an embodiment of the present invention allows the piston 100 to be cast without a pull in the die-cast tool. The disjoint half-cylinder structure may be contrasted with a bore formed as a complete cylinder, which may require a die-cast process including a pull.

To tighten the piston bearing bore 110, a threaded bolt 116 or the like is inserted in the aforementioned bores through the clamping structures 120 and 130. (See FIG. 3.) A complementary nut 118 or the like abuts against either of the clamping structures to capture the bolt 116. In an alternate exemplary embodiment, one or more of the half-cylinder portions 122, 124, 132, 134 can be formed with threads to engage the threads of the bolt 116.

Figure 6:
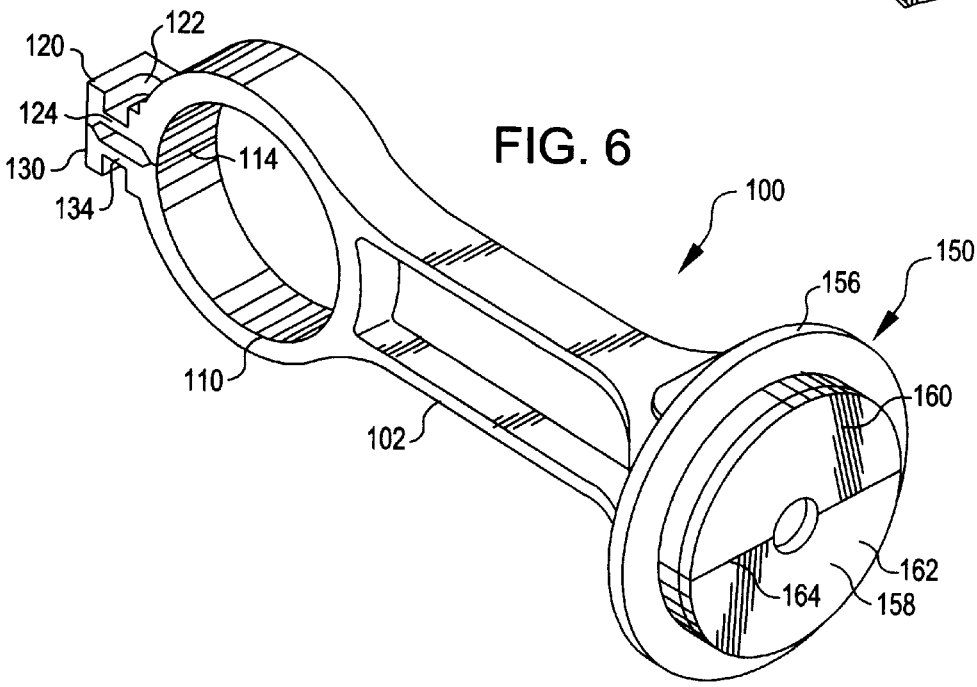
FIG. 6 is a perspective view of the piston of FIG. 3.

FIG. 6 is a perspective view of the piston of the air compressor of FIG. 1. The clamping structure 120 includes half-cylinders 122 and 124, and the clamping structure 130 includes half-cylinders 132 and 134. The clamping structure 120 is separated from the clamping structure 130 by the slit 114. The half-cylinder 122 does not overlap the half-cylinder 124, and the half-cylinder 132 does not overlap the half-cylinder 134. Therefore, the screw hole formed by the half-cylinders 122, 124, 132 and 134 is not a complete cylinder.

In an alternate embodiment, the fastening bore portions may be other than half-cylinders. For example, each portion may be less than one half-cylinder; e.g., an arc portion forming less than one half the circumference of a circle.

Moreover, the fastening bore portions need not be circular; for example, one or more portions may have a polygonal cross-section.

Figure 7:
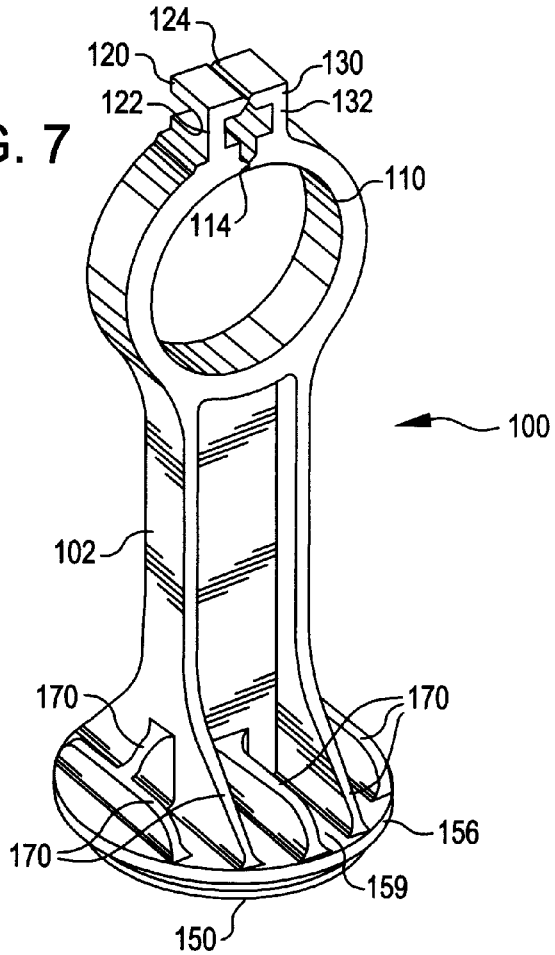
FIG. 7 is a further perspective view of the piston of FIG. 3.

FIG. 7 is a further perspective view of the piston of FIG. 6. The piston 100 includes a piston bearing bore 110, a piston head 150, and a piston seal rim 156. A piston bearing 112 may be seated in the piston bearing bore 110. The eccentric boss 22 extends through the center of the piston bearing 112. The piston bearing bore 110 is divided by the slit 114.

As shown in FIG. 7, the piston 100 preferably includes a plurality of piston cooling fins or features 170. In the exemplary embodiment shown, the piston cooling fins 170 are generally planar metal extensions which act to cool the entire piston 100 by increasing the surface area of the piston and thereby transferring heat from the piston 100 to air in the space behind the piston head 150. The air behind the piston head 150 is not compressed by the piston head and as such is relatively cool and may be exchanged or replenished by the action of the fan 400 or by the action of the piston 100 itself. Moreover, the space behind the piston head 150 is in fluid communication with the ambient air. As the piston 100 reciprocates, a movement of air may be set up which aids in the transfer of heat from the piston 100.

In an exemplary embodiment, the piston 100 is cast from a unitary piece of metal. With the cooling fins 170 thus cast as integral features of the piston 100, the cooling fins 170 help to reduce the heat of the entire piston 100. The cooling fins 170 on the piston 100 also help reduce the temperature of the piston seal 152. With the piston and seal cooler, the entire air compressor 1 runs cooler. This increases the life of wear parts such as the piston seal 152 and increases the efficiency of the air compressor 1. A wide variety of sizes, shapes and numbers of cooling fins 170 may be included. Alternately, the piston cooling fins 170 may be integral with only a portion of the piston 100, such as the piston head portion.

In an alternate embodiment, the piston need not be constructed as one integral member. In further embodiments, cooling fins may be located on other parts of the piston, such as on the piston rod.

Figure 8:
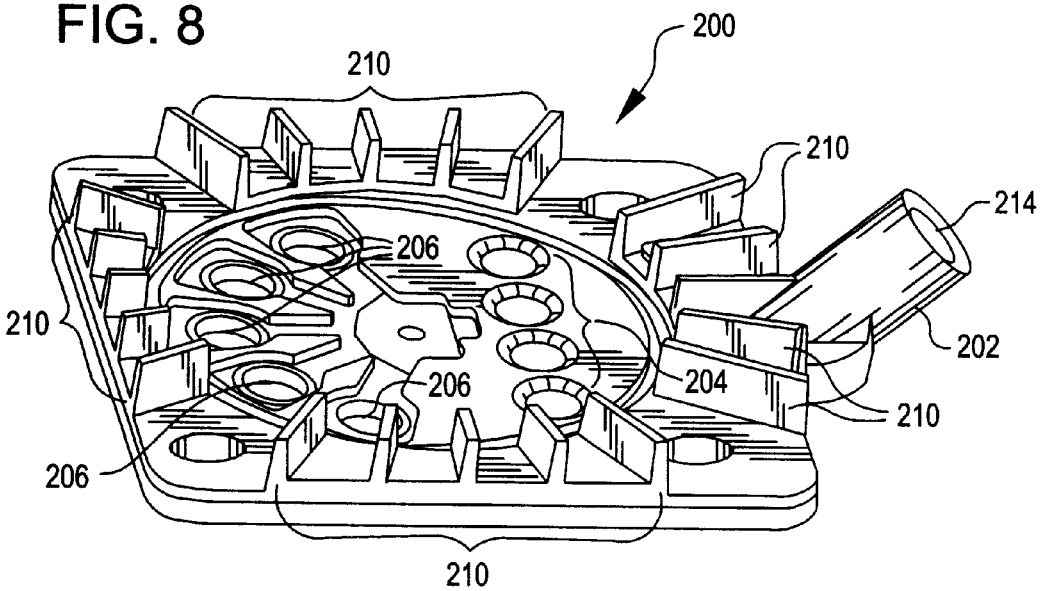
FIG. 8 is a perspective view of an exemplary embodiment of a valve plate of an air compressor in accordance with the present invention.

FIG. 8 is a perspective view of the valve plate 200 of the air compressor embodiment shown in FIG. 1. In FIG. 8 the valve plate 200 is seen from the side which mates with the cylinder 30. The valve plate 200 includes an angled integral valve plate outlet 202, which is an outlet port allowing air to exit one of the air spaces 34 (FIG. 1) defined by the cylinder head 32. A valve plate outlet opening 214 extends through the valve plate outlet 202. The valve plate 200 includes a set of exhaust holes 204 and a set of intake holes 206. A valve (not shown) covers each of the exhaust holes 204 and intake holes 206. During a piston up-stroke, the valves over the exhaust holes 204 open, allowing air to flow out of the cylinder 30 through the exhaust holes 204 and exit the compressor 1 via the valve plate outlet 202. During a piston down-stroke, the valves covering the intake holes 206 open, allowing air to flow into the cylinder 30 through the intake holes 206.

In a preferred embodiment, the valve plate 200 includes a set of cooling fins 210. The valve plate cooling fins 210 are preferably located on the side of the valve plate 200 which mates with the piston 100 but can also be located on the opposite side of the valve plate. The valve plate cooling fins 210 are preferably planar metal extensions which act to cool the valve plate 200. The valve plate cooling fins 210 are preferably located in a radial pattern to reduce turbulence as air flows over and around the fins. When the cylinder 30 mates with the valve plate 200, the cooling fins 210 surround the cylinder 30. Air provided by the cooling fan 400 flows axially along the cylinder 30 and flows over the valve plate cooling fins 210. Heat from the cylinder 30 and the valve plate 200 is transferred to the air flowing over the cylinder 30 and the cooling fins 210. This reduces the heat of the overall compressor 1, and thus increases the efficiency of the compressor 1 and the life of certain wear parts.

Figure 9:
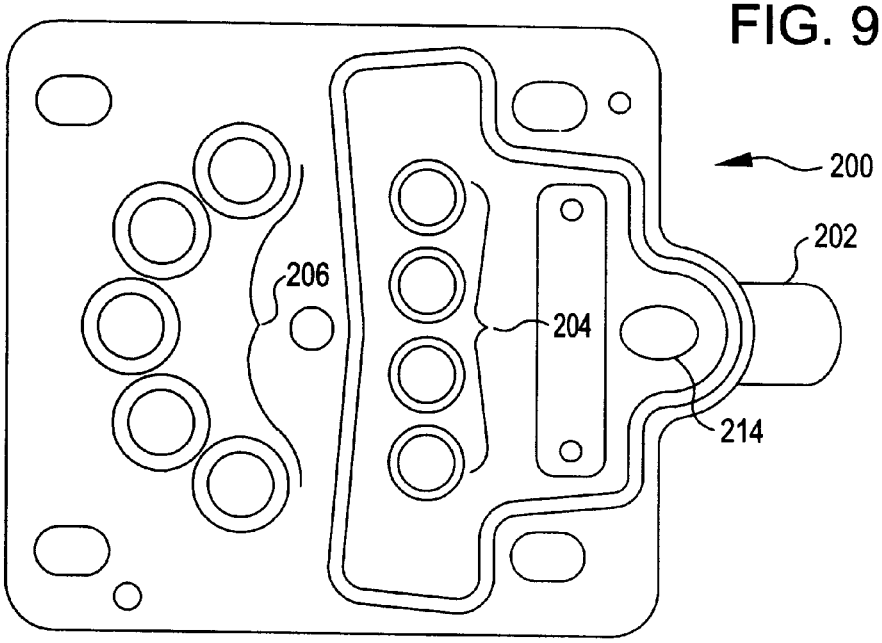
FIG. 9 is a plan view of the valve plate of FIG. 8.

FIG. 9 is a plan view of the valve plate of the embodiment of the air compressor of FIG. 1. In FIG. 9 the valve plate 200 is seen from the side which mates with the cylinder head 32. The valve plate 200 includes an angled integral valve plate outlet 202 having a valve plate outlet opening 214 therethrough. In an exemplary embodiment, the angle between the valve plate outlet 202 and the valve plate 200 is approximately 60 degrees. Alternately, other angles may be used. The valve plate 200 includes a set of exhaust holes 204 and a set of intake holes 206.

In operation, during a piston up-stroke, the piston 100 pushes air out of the cylinder 30, through the valve plate 200, into the air space 34, and out of the valve plate outlet 202 via the valve plate outlet opening 214. Air flows upward through the air space 34 and is redirected to flow downward out of the valve plate outlet 202. This redirection contributes to turbulence and flow resistance which, if not reduced, may lower the efficiency of the compressor 1. Angling the valve plate outlet 202 as shown reduces the angle at which the air must be redirected, thus reducing turbulence and flow resistance, and increasing the efficiency of the pump.

In a preferred embodiment, the valve plate outlet 202 is integral with the valve plate 200. Making the valve plate outlet 202 integral with the valve plate 200 reduces manufacturing costs. The valve plate outlet 202 is cast and machined as part of the casting and machining of the valve plate 200. Current designs include a valve plate outlet which includes an extra component which screws into a valve plate, increasing manufacturing costs. Furthermore, the outlet 202 can advantageously be formed to comprise a compression fitting.

A preferred embodiment of the present invention includes a fan which is efficient at multiple rotational speeds. Preferably, the fan is a centrifugal fan including two sets of fan blades: one set designed to operate most efficiently in a first range of rotational speeds, and a second set designed to operate most efficiently in a second range of rotational speeds. The fan of the present invention can thus produce greater airflow over two speed ranges.

Figure 10:
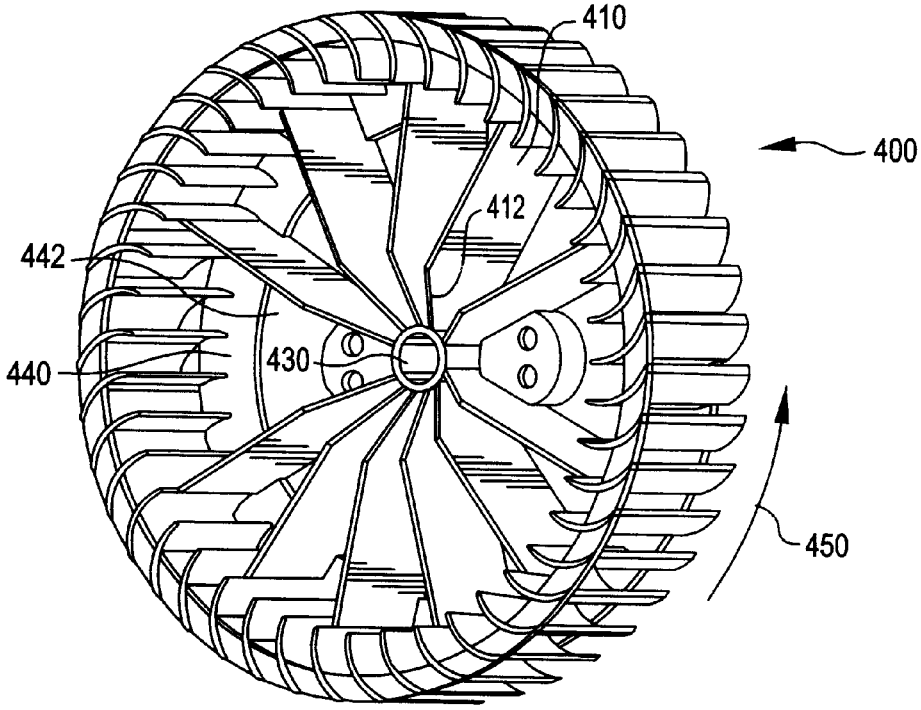
FIG. 10 illustrates an exemplary embodiment of a cooling fan of an air compressor in accordance with the present invention.

FIG. 10 illustrates an exemplary embodiment of a fan 400 for use in an air compressor of the present invention. The fan 400 includes a set of inner fan blades 410 for propelling air at a first set of speeds, and a set of outer fan blades 420 for propelling air at a second set of speeds. Preferably, the inner fan blades 410 are substantially straight, radial, flat paddle wheel blades, and are most efficient at a range of rotational speeds centered around approximately 1,725 r.p.m. (e.g., 1,500–2,000 r.p.m.). Preferably the outer fan blades 420 are curved blower wheel blades, and are most efficient at a range of rotational speeds centered around approximately 3,450 r.p.m. (e.g., 3,000–4,000 r.p.m.). Each blade of the inner fan blades 410 may have a cutout portion, such as cutout portion 412. The back 440 of the fan 400 may include vents or a cutout portion 442, which allows air to flow in from the back 440 as well as from the front. Alternately, the body of the fan 400 may be solid.

In operation, the eccentric boss 22 turns the fan 400 in the direction of the forward curve of the set of fan blades 420

(counter-clockwise, as shown in FIG. 11). A vacuum is formed in the center region of the fan 400, and air enters the fan 400 in this center region. The spinning of the fan blades 410 and 420 causes air to be propelled radially from the center of the fan 400 to and out of the periphery of the fan 400, flowing between the outer fan blades 420. The fan 400 draws air in through the shroud 40 and blows the air upwards, axially around the cylinder 30, across the valve plate cooling fins 210, and out of the vents 54, thereby cooling the motor 4, valve plate 200, cylinder 30, and other parts of the air compressor 1.

The speed of the motor 4, and thus the speed of the fan 400, may vary. If the fan 400 is rotating at a range of speeds of approximately 1,500–2,000 r.p.m., the outer fan blades 420 propel air through the fan 400, but the inner fan blades 410 propel air through the fan 400 more efficiently. If the fan 400 is rotating at a range of speeds of approximately 3,000–4,000 r.p.m., the inner fan blades 410 propel air through the fan 400, but the outer fan blades 420 propel air through the fan 400 more efficiently. At speeds between these ranges the fan 400 may operate with varying levels of efficiency; however, at all operational speeds the fan 400 operates more efficiently than a fan having only one set of fan blades. In one embodiment of the compressor of the present invention, a fan is tailored to correspond to certain discrete compressor speed settings.

In one embodiment, the fan 400 is molded from plastic, but may be manufactured of other materials. In alternate embodiments other types of fan blades may be used, and other numbers of sets of fan blades may be used. For example, curved fan blades need not be used. In further embodiments, the sets of fan blades may be constructed to be most efficient at other speeds. In an alternate embodiment, the variable speed fan of the present invention may be used in other applications, such as a drying or air moving apparatus.

In a preferred embodiment of the present invention, cooling air flows through the compressor 1 in a novel and efficient manner. The fan 400 draws outside air in through the shroud 40 and propels the air axially along the outside of the cylinder 30. The cylinder shroud 50, surrounding the cylinder 30, defines an air space 52. Air flows upward through the air space 52 between the cylinder 30 and the cylinder shroud 59, past the cooling fins 210 of the valve plate 200, and exits the compressor at the vents 54. Such an air flow makes more efficient use of the work being done to propel cooling air by allowing the cooling air to be in greater contact with the cylinder 30. Existing designs in which air is propelled in other directions, for example in a direction perpendicular to the cylinder, do not provide as efficient a cooling process.

While the compressor and compressor components of the present invention are described with respect to specific embodiments, it should be noted that the present invention may be implemented in different manners and used with different applications. For example, not all of the features described herein need be included in a compressor according to an embodiment of the present invention. Such a compressor may, for example, include a piston with an angled head, but omit a cooling fan which operates at multiple speeds or a pump frame with a flat face.

What is claimed is:

1. A piston for use in a cylinder of a compressor, the piston comprising:

a bearing bore;

a piston head;

a connecting rod, the connecting rod connecting the piston head to the bearing bore; and a piston seal rim, wherein the piston seal rim is angled relative to the piston head, wherein the piston reciprocates in the cylinder, and wherein during a portion of an upstroke of the piston the piston seal rim is substantially perpendicular to the axis of the cylinder.

2. The piston of claim 1 comprising a piston seal resting on the piston seal rim.

3. The piston of claim 1 wherein the piston seal rim is angled relative to the piston head in a first axis and is not angled relative to the piston head in a second axis, wherein the first axis is perpendicular to the second axis.

4. The piston of claim 1 comprising:

a bearing bore including:

a first extension including at least a first barrel portion and a second barrel portion;

a second extension including at least a third barrel portion and fourth barrel portion; and a slit, the slit dividing the bearing bore and extending between the first and second extensions.

5. The piston of claim 1 wherein the piston head includes a piston face, the piston face comprising two substantially flat planes, wherein the two planes meet at an angle.

6. A piston in an air compressor having a cylinder, the piston comprising:

a connecting rod;

a piston head; and a piston seal mounting location extending around the piston head, wherein the piston seal mounting location is angled relative to the piston head, wherein the piston reciprocates in the cylinder, and wherein during a portion of an upstroke the piston seal mounting location is substantially perpendicular to the axis of the cylinder.

7. The piston of claim 6, wherein the piston seal is angled relative to the piston head in a first axis and is not angled relative to the piston head in a second axis.

* * * * *